US005405307A

United States Patent [19]

Borgström et al.

[11] Patent Number: 5,405,307

[45] Date of Patent: Apr. 11, 1995

[54] CENTRIFUGAL SEPARATOR WITH A PARING DEVICE

[75] Inventors: Leonard Borgström, VästerÅs; Patrik Brehmer, Täby; Claes-Göran Carlsson; Peter Franzén, both of Tullinge; Claes Inge, Saltsjö-Duvnäs; Torgny Lagerstedt; Hans Moberg, both of Stockholm, all of Sweden

[73] Assignee: Alfa Laval Separation AB, Tumba, Sweden

[21] Appl. No.: 204,402

[22] PCT Filed: Sep. 17, 1993

[86] PCT No.: PCT/SE93/00756

§ 371 Date: Mar. 9, 1994

§ 102(e) Date: Mar. 9, 1994

[87] PCT Pub. No.: WO94/06565

PCT Pub. Date: Mar. 31, 1994

[30] Foreign Application Priority Data

Sep. 21, 1992 [SE] Sweden ..... 9202733

[51] Int. Cl.[6] ..... B04B 1/08; B04B 11/08

[52] U.S. Cl. ..... 494/57; 494/70

[58] Field of Search ..... 494/2, 3, 56, 57, 65, 494/67–73; 210/380.1

[56] References Cited

U.S. PATENT DOCUMENTS

| | | | |
|---|---|---|---|
| 1,256,810 | 2/1918 | Leitch et al. | 494/70 X |
| 2,622,796 | 12/1952 | Steinacker et al. | 494/71 X |
| 2,622,797 | 12/1952 | Hemfort | 494/70 X |
| 2,667,338 | 1/1954 | Hemfort | 494/56 X |
| 4,406,652 | 9/1983 | Nielsen | 494/56 |
| 5,160,311 | 11/1992 | Inge et al. | 494/70 X |

FOREIGN PATENT DOCUMENTS

| | | | |
|---|---|---|---|
| 60659 | 2/1943 | Denmark . | |
| 3936150 | 6/1990 | Germany . | |
| 133467 | 10/1951 | Sweden | 494/56 |
| 8802664 | 4/1988 | WIPO . | |

*Primary Examiner*—David A. Scherbel
*Assistant Examiner*—Charles Cooley
*Attorney, Agent, or Firm*—David Hoxie Faithfull & Hapgood

[57] ABSTRACT

Centrifugal separator comprising a rotor, which forms an inlet for the liquid which is to be centrifugally treated and an outlet chamber (17) for a liquid separated in the rotor, the outlet chamber (17) surrounding the rotational axis and being so designed that liquid present in the outlet chamber during operation rotates around the rotational axis and has a radially inward facing circular free liquid surface at a certain radial level in the rotor. A stationary discharge device ( 21 ) extends in the outlet chamber (17) from the liquid body radially inward to a central outlet (25) and in the area of the free liquid surface it forms an inlet opening (23), which is directed toward the rotational direction of the liquid body and partly is located in the liquid body, the discharge device also forming a flow channel (28), which connects the inlet opening (23) to the central outlet. To obtain a high outlet pressure with minor risk of air admixture and good stability, the inlet opening (23) is delimited by an edge, which upstream has a front edge portion (30) radially inside the free liquid surface and downstream has a rear edge portion (31) radially outside the free liquid surface, a straight line (32) drawn through said edge portions (30, 31) forming an angle (V) with a tangent to the free liquid surface at the inlet opening (23), the angle being greater than 20° but smaller than 50° and the vertex of the angle being directed in the rotational direction.

6 Claims, 2 Drawing Sheets

CENTRIFUGAL SEPARATOR WITH A PARING DEVICE

FIELD OF THE INVENTION

The present invention concerns a centrifugal separator comprising a rotor, which is rotatable around a rotational axis and has an inlet for the liquid to be centrifugally treated and an outlet chamber for a liquid separated in the rotor, the outlet chamber surrounding the rotational axis and being so designed that liquid present in the outlet chamber during operation forms a rotating liquid body around the rotational axis which has a radially inwardly facing free circular liquid surface at a certain radial level in the rotor. The centrifugal separator also comprises: a stationary discharge device in the outlet chamber, extending from the said liquid body radially inwardly to the central outlet, and, in the area of the free liquid surface forming an inlet opening, which is directed towards the rotational direction of the liquid body and is partly located in the liquid body, the discharge device also forming a flow channel, which connects the inlet opening to the central outlet.

BACKGROUND OF THE INVENTION

A centrifugal separator of the kind referred is shown in WO 88/102664. Because the inlet opening of the outlet device in this centrifugal separator during operation is located only partly radially outside the free a liquid surface, a liquid of a high viscosity can be separated in and discharged out of such a centrifugal separator. However, the flow conditions in the flow channel near the inlet opening are such that a part of a liquid of high viscosity flowing into the flow channel turns and flows out again into the outlet chamber through the part of the inlet: opening located radially inside the free liquid surface. This results in a low outlet pressure, a great risk of air admixture and an increased risk of instability.

If one tries to reduce the return flow of separated liquid from the flow channel out through the inlet opening to the outlet chamber by diminishing the radius of the free liquid surface a wave is created in front of the inlet opening, the energy consumption increases to a high degree and the outlet pressure becomes low.

SUMMARY OF THE INVENTION

An object of the present invention is to provide a centrifugal separator of the kind initially described, in which a liquid of viscosity higher than 100 cSt can be separated and discharged out of the outlet chamber with a satisfactory high outlet pressure and low risk of air admixture and instability.

In accordance with the invention the foregoing object is achieved by designing a centrifugal separator of the kind described having an inlet opening, which is delimited by an edge, which upstream of the inlet opening has a front edge portion radially inside the free liquid surface and downstream of the inlet opening has a rear edge portion radially outside the free liquid surface. A straight line drawn through said edge portions forms an angle with a tangent to the free liquid surface at the inlet opening which is greater than 20° but smaller than 50°, and the vertex of the angle being directed in the rotational direction.

By designing the inlet opening in this way one causes the part of the separated liquid, which flows out again through the inlet opening, immediately to flow against the free liquid surface, so that it is once again conducted into the flow channel.

In a preferred embodiment of the invention the discharge device has at least one tubular element, which forms a part of the flow channel, and which during operation has its radially outermost part located in the rotating liquid body while the remaining parts of the discharge device are located radially inside the rotating liquid body.

In order to make adjustment of the radial position of the free liquid surface possible if is proposed, in another embodiment of the invention that the tubular element be arranged movably in the discharge device in such a way that the inlet opening of the flow channel can be placed at a variable radius.

The tubular element is then preferably movable along its longitudinal axis.

In a special embodiment of the invention a flow channel comprises a central flow chamber in the discharge device, which flow chamber is circular cylindrical and concentric with the rotational axis.

BRIEF DESCRIPTION OF THE DRAWINGS

The invention will be described more closely with reference to the attached drawings, in which.

DESCRIPTION OF PREFERRED EMBODIMENTS

Figure 1:
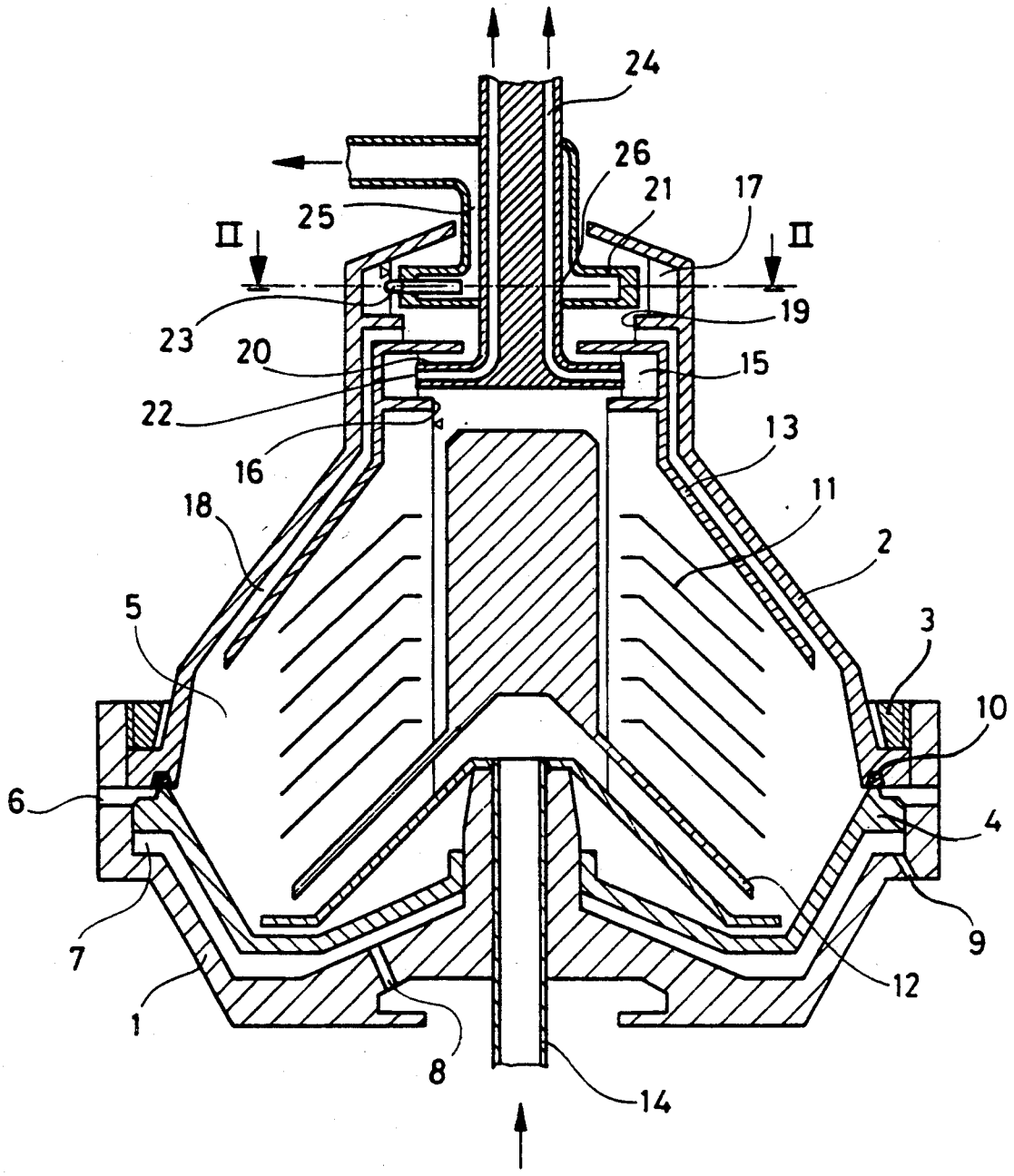
FIG. 1 schematically shows an axial section through a part of a centrifugal separator according to the invention.

In FIG. 1 there is shown a part of a centrifugal separator comprising a rotor, which has a lower part 1 and an upper part 2, joined are joint together axially by means of a locking ring 3. Inside the rotor there is arranged an axially movable valve slide 4. This valve slide 4 defines, together with the upper part 2, a separation chamber 5 and is arranged to open and close an outer passage between the separation chamber 5 and the outlet opening 6 to let out a component which has been separated from a mixture supplied to the rotor and collected at the periphery of the separation chamber 5 intermittently. The valve slide 4 defines together with the lower part 1 a closing chamber 7, which is provided with an inlet 8 and a throttled outlet 9 for a so called closing liquid. During rotation of the rotor the valve slide 4 is pressed by the pressure of the closing liquid present in the closing chamber 7 under the influence of centrifugal force into sealing abutment against a gasket 10 arranged in the upper part 2.

Inside the separation chamber 5 a disc stack 11 consisting of a number of conical separation discs is arranged between a distributor 12 and a top disc 13. In the embodiment shown in FIG. 1 the rotor is mounted on a hollow shaft 14, through which the liquid to be centrifugally treated is supplied to the rotor. The top disc 13 forms at its upper end in the figure shown a centrally located first outlet chamber 15 for a specific lighter liquid component separated in the separation chamber 5. This first outlet chamber 15 communicates with the separation chamber 5 via a first overflow outlet 16, over which the specific lighter liquid component can flow out of the separation chamber 5.

The upper part of the rotor 2 forms a centrally located second outlet chamber 17, into which a specific heavier liquid component can flow from a radially outer portion of the separation chamber 5 via a passage 18 and a second overflow outlet 19.

In each outlet chamber there is arranged a stationary discharge device, a first discharge device 20 and a second discharge device 21. These discharge devices are provided with peripheral inlet openings, first inlet openings 22 and second inlet openings 23, respectively, which are connected to central outlets, a first outlet 24 and a second outlet 25, respectively. The discharge devices 20 and 21 extend mainly perpendicularly to the rotational axis so far out radially during operation they are partly located in a rotating liquid body located in the outlet chamber 15, 17 respectively.

Figure 2:
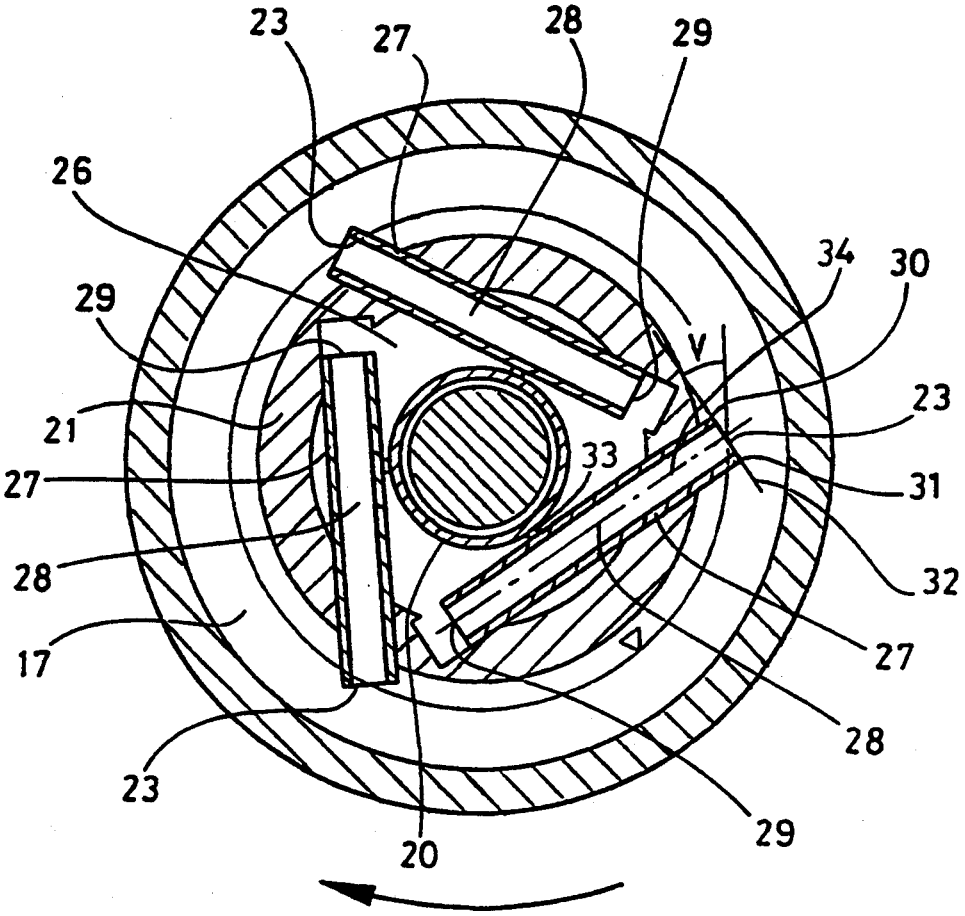
FIG. 2 shows a section along the line II—II in FIG. 1.

As shown in FIGS. 1 and 2 a flow chamber 26 is formed in a radially inner part of the second discharge device 21. In the shown embodiment the flow chamber 26 is cylindrical and concentrically surrounds the rotational axis. At its radially outer part, the second discharge device 21 is provided with three straight tubular elements 27, which ]partly project radially outwardly from the radially inner part of the second discharge device 21. Each tubular element forms inside itself a flow channel 28, which has a peripheral inlet opening 23 facing towards the rotational direction of the rotor and an outlet opening 29, which opens into the flow chamber 26. The tubular elements extend so far out in radially the outlet chamber 17 that the inlet openings 23 during operation are partly located radially outside the free liquid surface. Upstream the inlet opening 23 has a front edge portion 30, which during operation is located radially inside the free liquid surface downstream the inlet opening has a rear edge portion 31, which during operation is located radially outside the free liquid surface. A line 32 connecting these edge portions 30 and 31 and a tangent to the free liquid surface at the inlet opening 23 form an angle V, greater than 20° but smaller than 50°, the vertex of the angle being directed in the rotational direction. The axis 34 of each tubular element 27 is perpendicular to the line 32.

The tubular elements 27 are movably arranged in the second outlet device 21 in such a way that the inlet openings 23 of the flow channels 28 can be placed at different radii.

As indicated in FIG. 2 this can be accomplished by turning the first discharge device 20 around the rotational axis. The tubular elements 27 which are connected to the discharge device by means of connections 33, are then displaced along their longitudinal axis.

The centrifugal separator shown in the figures works in the following manner:

In connection with the starting of a centrifugal separator of this kind and bringing the rotor to rotate the separation chamber 5 is closed by supplying a closing liquid -to the closing chamber 7 through the inlet 8. As soon as the separation chamber 5 is closed, the liquid mixture, which is to be centrifugally treated, is supplied to the separation chamber 5 through the hollow shaft 14. When the rotor has reached the rotational speed of operation and the separation chamber has been filled up, the components contained in the liquid mixture are separated by the influence of centrifugal forces. The separation then mainly takes place in the intermediate spaces between the conical discs in the disc stack 11. During separation a specific heavier liquid component is thrown radially out towards the periphery of the separation chamber 5 where it is accumulated, while a specific lighter liquid component flows radially inwards in these intermediate spaces.

If the centrifugally treated liquid mixture also contains specific heavy particles these are accumulated at the outermost periphery of the separation chamber 5.

The specific lighter liquid component flows over to the first outlet chamber 15 via the overflow outlet which, thereby, will determine the radial level of the free liquid surface in the separation chamber 5. The light liquid component is discharged under pressure out of the centrifugal rotor via the first stationary discharge device 20, which in this case consists of a conventional paring disc.

The specific heavier liquid component, which has been accumulated at the periphery of the separation chamber, flows radially inward through the passage 8 and via the overflow outlet 19 into the outlet chamber 17. Here it forms a cylindrical liquid body which is kept in rotation. During operation the second discharge device 21 extends radially so far out: in the second outlet chamber 17 that so much of the tubular element 27 is immersed in the rotating liquid body that the inlet opening 23 is only partly is located in the rotating liquid while the remaining parts of the outlet device 21 are located radially inside the rotating liquid body. For this reason the friction between the outside of the discharge device 21 and the rotating liquid body will be low.

Specific heavier component flows in through the inlet openings 23 to the flow chamber 26. From there it flows further out through the central outlet 25.

The through flow area for the specific heavier liquid component, when this has passed through the tubular elements 27, is greater than the total cross sectional area of the flow channels in the tubular elements.

In the shown embodiment an interface in the separation chamber 5 between the specific lighter and the specific heavier liquid component is positioned during operation, the radial position of the interface being determined inter alia by the position of the two overflow outlets 16 and 19. However, it is quite possible to design a centrifugal separator according to the invention without the second overflow outlet 19 and to let the liquid level in the outlet chamber 17 determine the radial position of the interface.

What is claimed is:

1. Centrifugal separator comprising a rotor which is rotatable around a rotational axis and forms an inlet for the liquid which is to be centrifugally treated and an outlet chamber (17) for a liquid separated in the rotor, the outlet chamber (17) surrounding the rotational axis and being so designed that liquid present in the outlet chamber during operation forms a rotating liquid body around the rotational axis which liquid body has a radially inwardly facing circular free liquid surface at a certain radial level in the rotor, and a stationary discharge device (21) in the outlet chamber which extends from said liquid body radially inwardly to a central outlet (25) and in the area of the free liquid surface forms an inlet opening (23) which is directed towards the rotational direction of the liquid body and is located in part in the liquid body, the discharge device (21) also forming a flow channel which connects the inlet opening to the central outlet (25), characterized in that the inlet opening (23) is delimited by an edge, which upstream has a front edge portion (30) radially inside the free liquid surface and downstream has a rear edge portion (31) radially outside the free liquid surface, a straight line through said edge portions (30, 31) forming an angle (V) with a tangent to the free liquid surface at the inlet opening (23), the angle being greater than 20° but smaller than 50° and the vertex of the angle being directed in the direction of rotation of said rotor.

2. Centrifugal separator according to claim 1, characterized in that the discharge device (21) has at least one tubular element (27), the radially outermost part of said tubular element, during operation, being located in the rotating liquid body while the remaining parts of the discharge device (21) are located radially inside the rotating liquid body a part of the flow channel (28) being formed in said tubular element.

3. Centrifugal separator according to claim 2, characterized in that the at least one tubular element (27) has a straight longitudinal axis, which is perpendicular to said straight line (32).

4. Centrifugal separator according to claim 2, characterized in that the at least one tubular element (27) is arranged movably in the discharge device (21) in a way such that the inlet opening (23) of the flow channel is located at a variable radial distance from the rotational axis.

5. Centrifugal separator according to claim 4, characterized in that the at least one tubular element (27) has a longitudinal axis and is movable along said longitudinal axis.

6. Centrifugal separator according to claim 1 characterized in that the flow channel (28) comprises a central flow chamber (26), which is cylindrical and concentrically surrounds the rotational axis.

* * * * *